US011685591B2

(12) United States Patent
Poppe et al.

(10) Patent No.: US 11,685,591 B2
(45) Date of Patent: Jun. 27, 2023

(54) INTERFACE RING

(71) Applicant: Altachem NV, Harelbeke (BE)

(72) Inventors: Jean-Marie Poppe, Heule (BE); Wouter Halfmaerten, Bruges (BE)

(73) Assignee: Altachem NV, Harelbeke (BE)

( * ) Notice: Subject to any disclaimer, the term of this patent is extended or adjusted under 35 U.S.C. 154(b) by 11 days.

(21) Appl. No.: 17/625,840

(22) PCT Filed: Mar. 18, 2021

(86) PCT No.: PCT/EP2021/057008
§ 371 (c)(1),
(2) Date: Jan. 10, 2022

(87) PCT Pub. No.: WO2021/185993
PCT Pub. Date: Sep. 23, 2021

(65) Prior Publication Data

US 2022/0258954 A1 Aug. 18, 2022

(30) Foreign Application Priority Data

Mar. 20, 2020 (BE) ..... 2020/5184

(51) Int. Cl.
*B65D 83/24* (2006.01)
*B65D 83/40* (2006.01)

(52) U.S. Cl.
CPC ..... *B65D 83/24* (2013.01); *B65D 83/40* (2013.01)

(58) Field of Classification Search
CPC ..... B65D 83/24; B65D 83/40; B65D 83/38; B65D 83/48; B65D 83/32; B65D 83/206;
(Continued)

(56) References Cited

U.S. PATENT DOCUMENTS 290,663 A 12/1883 Blue
11,253,111 B2 * 2/2022 Casper ..... B65D 83/207

FOREIGN PATENT DOCUMENTS

DE 198 09 290 C1 8/1999
FR 555 656 A 7/1923
WO 2011/066062 A1 6/2011

OTHER PUBLICATIONS

International Search Report in PCT/EP2021/057008, dated Jun. 15, 2021.

* cited by examiner

*Primary Examiner* — Vishal Pancholi
*Assistant Examiner* — Robert K Nichols, II
(74) *Attorney, Agent, or Firm* — Collard & Roe, P.C.

(57) ABSTRACT

An interface ring which is the interface between a container and an applicator comprising a circular socket with a plurality of laterally extending protrusions, a cylindrical thread being arranged above the socket, a central cylindrical opening extending through the interface ring in the centre of the thread and the socket wherein the thread presents a plurality of interruptions extending axially from the socket to the upper end of the thread, the interruptions dividing the thread into thread portions. It is an object of the present invention to provide an optimized interface ring. In order to achieve this object, the interface ring comprises deformable vertical ribs laterally extending mostly parallel to the radial axis of the interface ring wherein the deformable ribs deform when the interface ring is mounted on the outer rim of the cup of a valve or by other means on to the container. An interface ring with an increased grip of the interface ring on the valve. Therefore, much higher turning and buckling forces can be reached.

4 Claims, 7 Drawing Sheets

Figure 1:
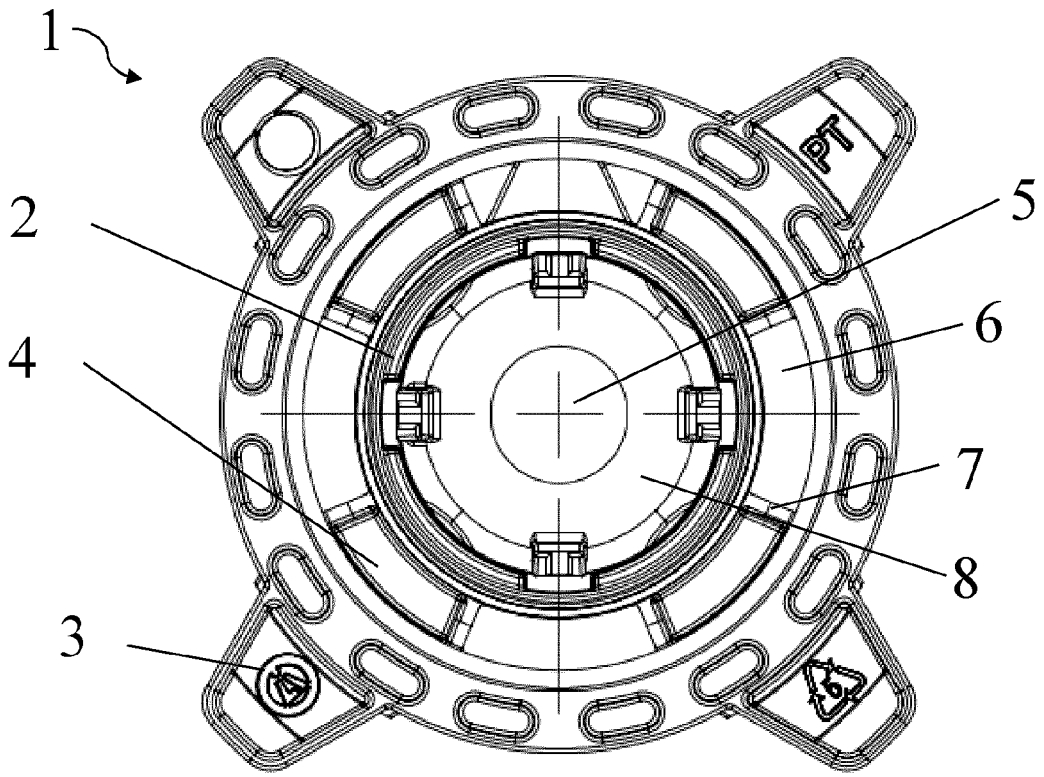

(58) Field of Classification Search
CPC .... B65D 83/303; B65D 83/14; B65D 83/207;
B05B 11/1077; B67D 1/04
See application file for complete search history.

SECTION F-F

SECTION D-D

Before mounting

SECTION E-E
After mounting

INTERFACE RING

CROSS REFERENCE TO RELATED APPLICATIONS

This application is the National Stage of PCT/EP2021/057008 filed on Mar. 18, 2021, which claims priority under 35 U.S.C. § 119 of Belgium Application No. BE2020/5184 filed on Mar. 20, 2020, the disclosure of which is incorporated by reference. The international application under PCT article 21(2) was published in English.

The invention concerns an interface ring which is the interface between a container and an applicator comprising a circular socket with a plurality of laterally extending protrusions, a cylindrical thread being arranged above the socket, a central cylindrical opening extending through the interface ring in the centre of the thread and the socket, wherein the thread presents a plurality of interruptions extending axially from the socket to the upper end of the thread, the interruptions dividing the thread into thread portions.

These interface rings are usually used as a connecting mean between a container and an applicator. They are also protecting the valve of the container. The applicator can be used for foam or any other product to be dispensed. The interface rings are comprised of a socket for mounting one end of the interface ring on the container and a thread for mounting the other end of the interface ring to the applicator. Therefore, the interface ring can be fixed to the valve cup or by other means on to the container. The interface ring has a central cylindrical opening extending through the interface ring in the centre of the thread and the socket. Through this central cylindrical opening the stem of a valve can be interconnected with a basket of the applicator.

It is an object of the present invention to provide an optimized interface ring.

This object is achieved according to the invention by an interface ring according to the preamble of claim 1 in which the interface ring comprises deformable vertical ribs laterally extending essentially parallel to the radial axis of the interface ring wherein the deformable ribs deform when the interface ring is mounted on the outer rim of the cup of a valve or by other means on the container.

The main advantages of these measures are the following. The invention results in an interface ring with a reduced mass, thus reducing the material costs for producing the interface ring. While the material costs are reduced, the mounting, turning and buckling forces holding the ring on the container are on the same level as for interface rings without the interruptions. Another advantage of the invention is that the interruptions of the thread increase the compatibility with different applicators. As the thread is interrupted it can more easily be forced into an inaccurate basket or into a basket that has a thread with slightly different pitch.

The deformable ribs deform when the interface ring is mounted on the outer rim of the cup of a valve or by other means on the container. This deformation increases the grip of the interface ring on the valve. Therefore, much higher turning and buckling forces can be reached.

As an advantage, the buckling load can be varied by the mounting force. By changing the air pressure during the mounting process, the mounting force of the interface ring can be changed. By adding more pressure, the ribs are deformed more and are fixed in a less stiff manner around the cup rim which results into a lower buckling load.

According to another embodiment of the invention, a security and tamper evidence seal is provided with extends at least partially over the opening of the interface ring.

This security and tamper evidence seal prohibit an unintentional actuation of the valve. Before the container is mounted on an applicator, this security and tamper evidence can be removed or broken.

According to one embodiment of the present invention, the security and tamper evidence seal is provided with a removing aid allowing the tamper evidence to be grabbed in order to pull-off the security and tamper evidence seal.

This allows to easily remove the security and tamper evidence seal from the interface ring before the container is mounted on the applicator.

The invention also concerns the use of an interface ring according to the invention between the valve of an aerosol dispenser and an aerosol container.

Figure 2:
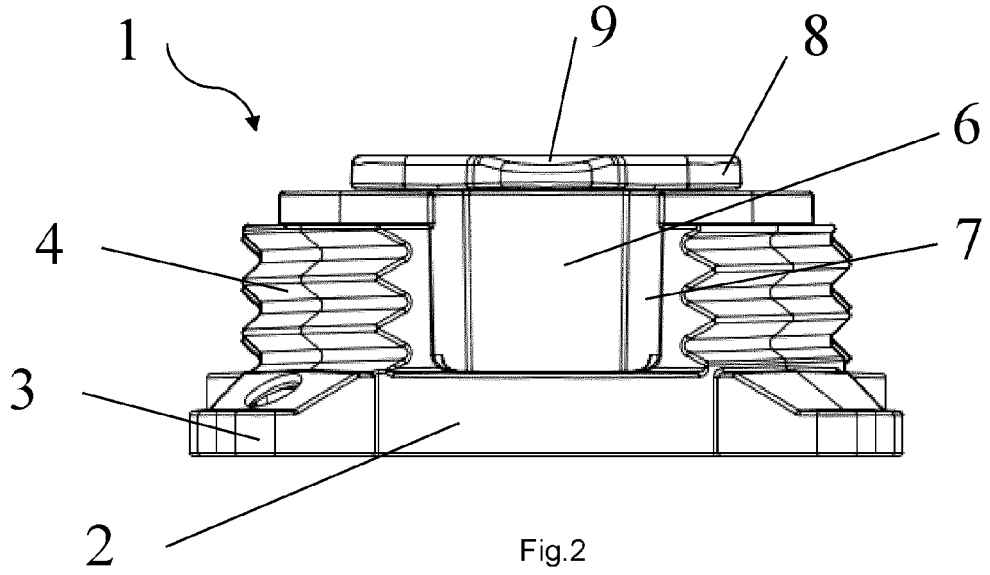
Figure 3:
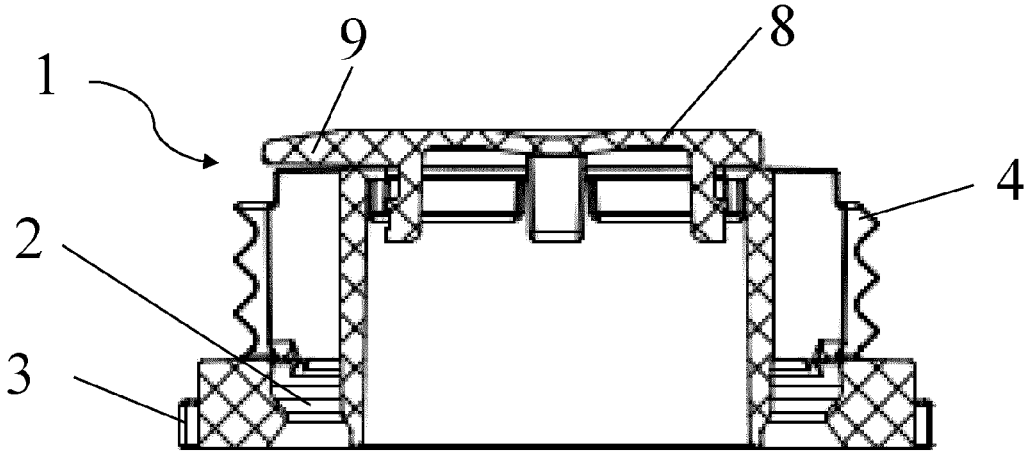
Figure 4:
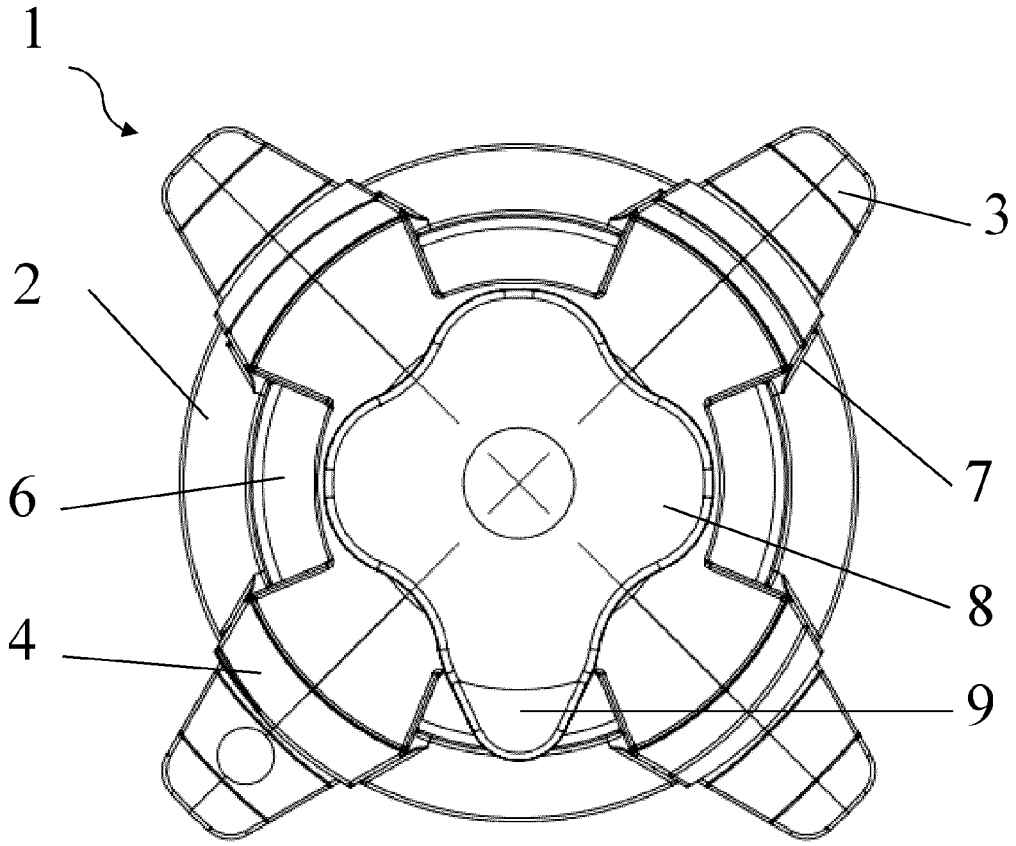
Figure 5:
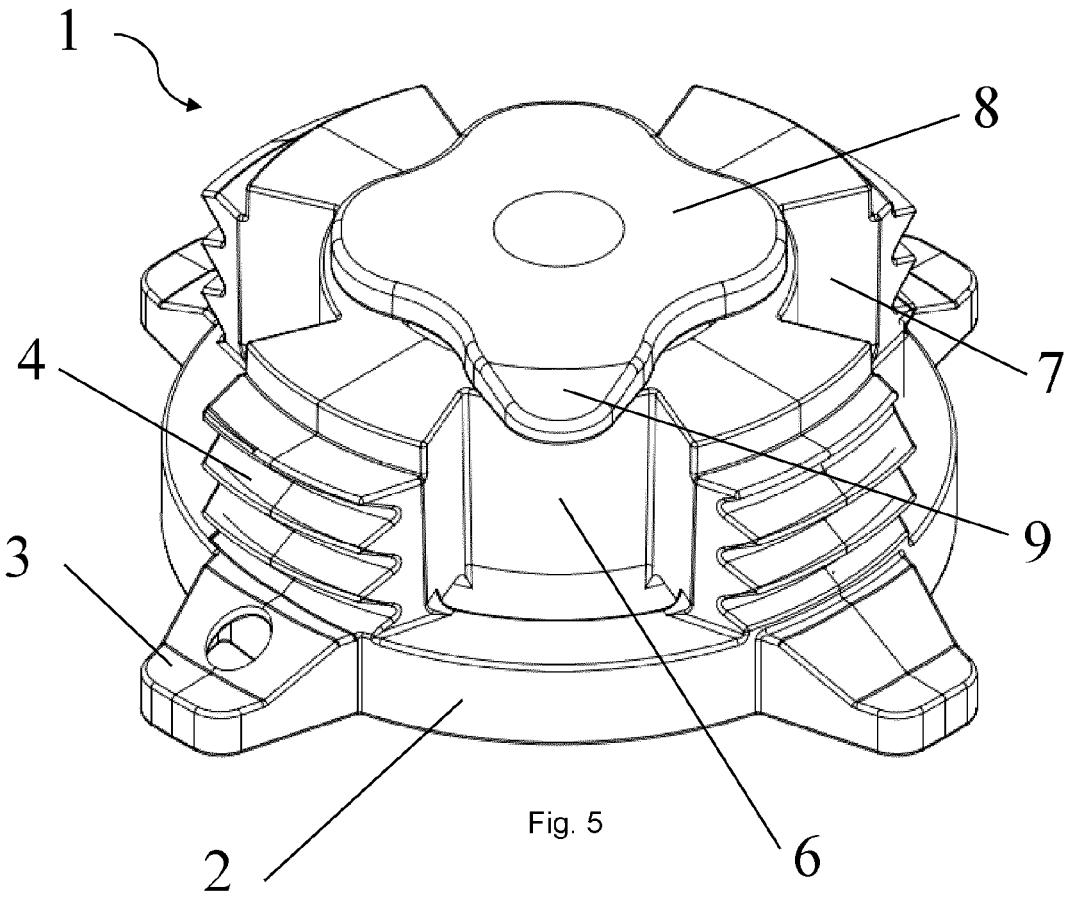
Figure 6:
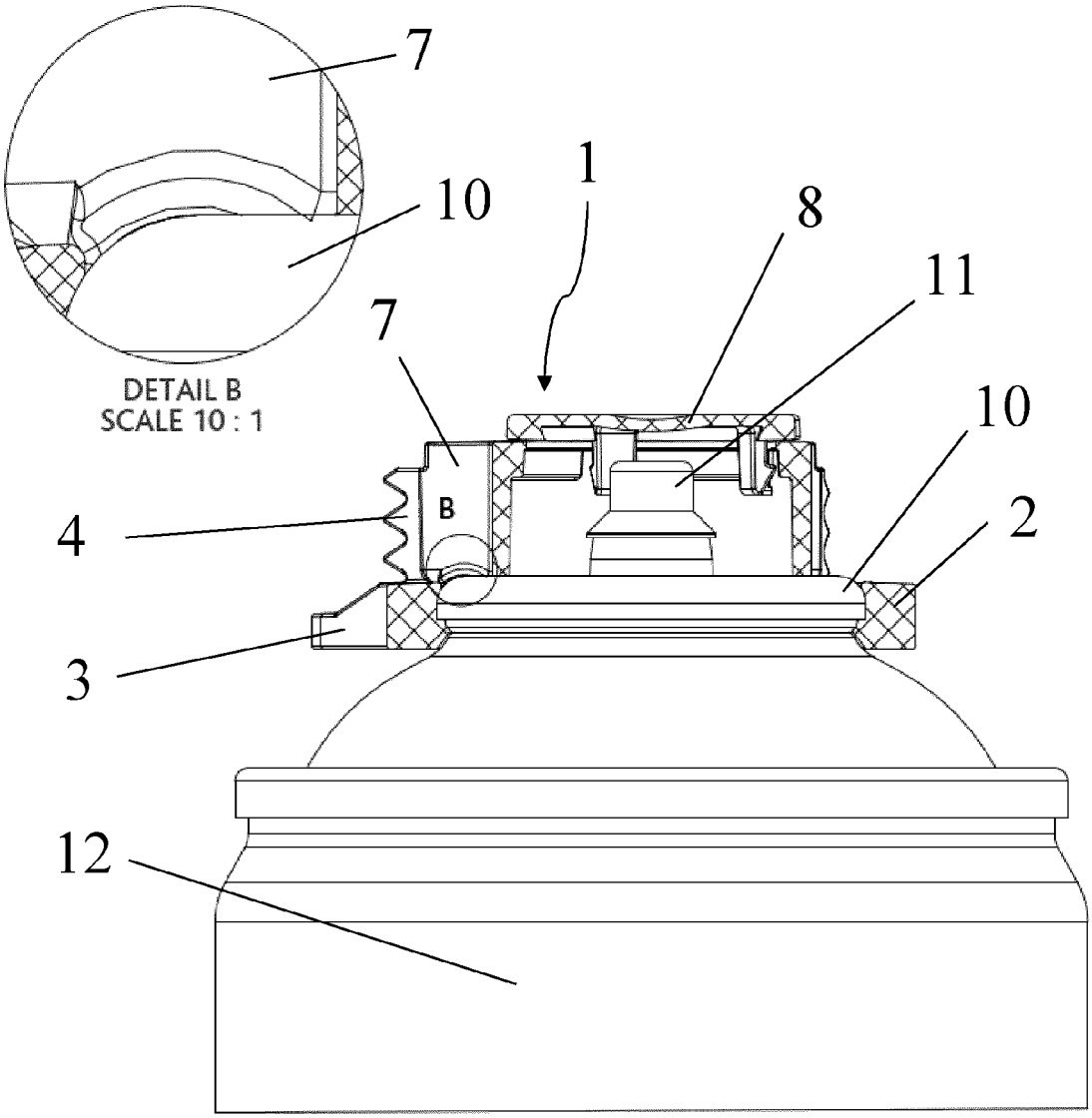
Figure 7:
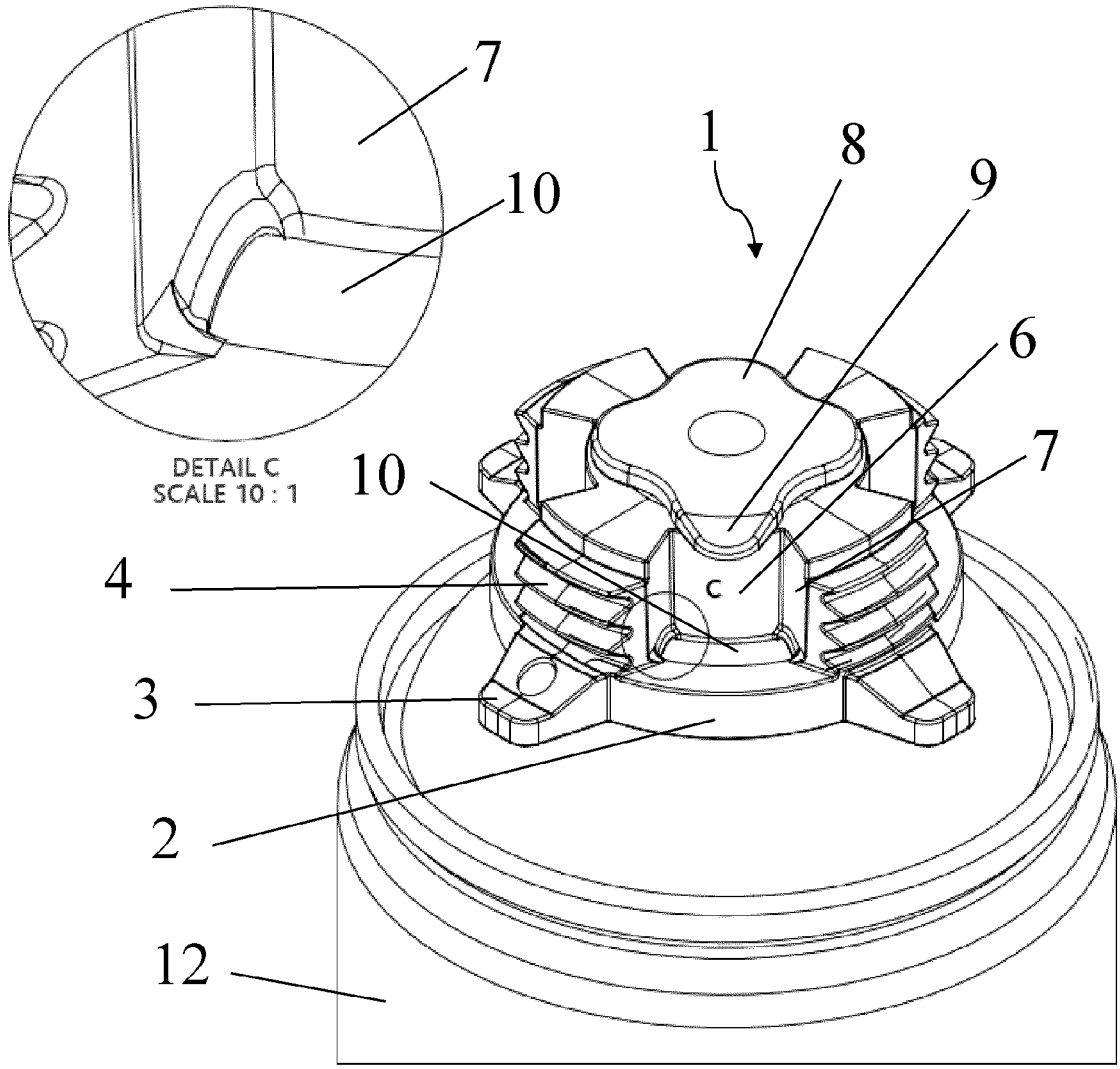
Figure 8:
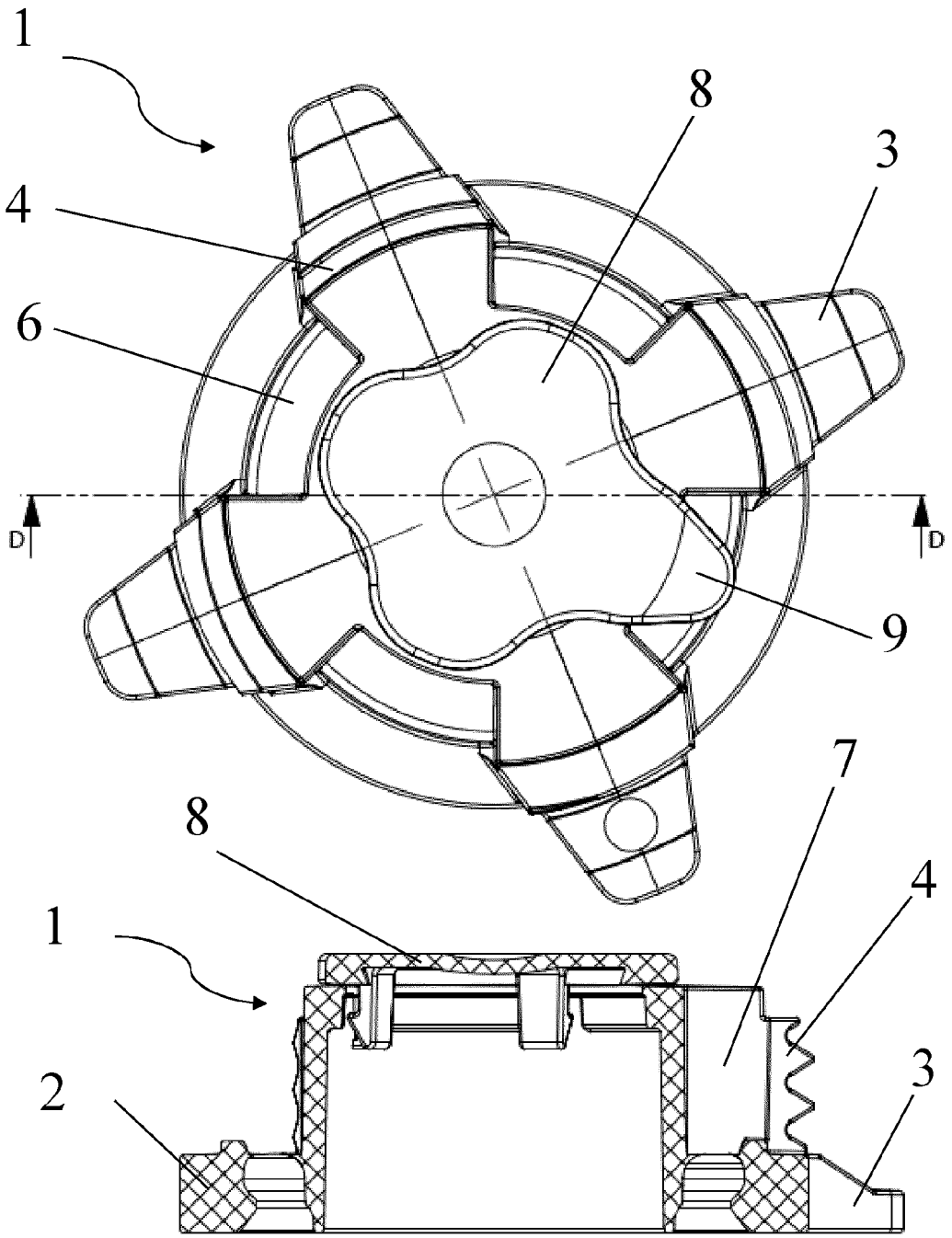
Figure 9:
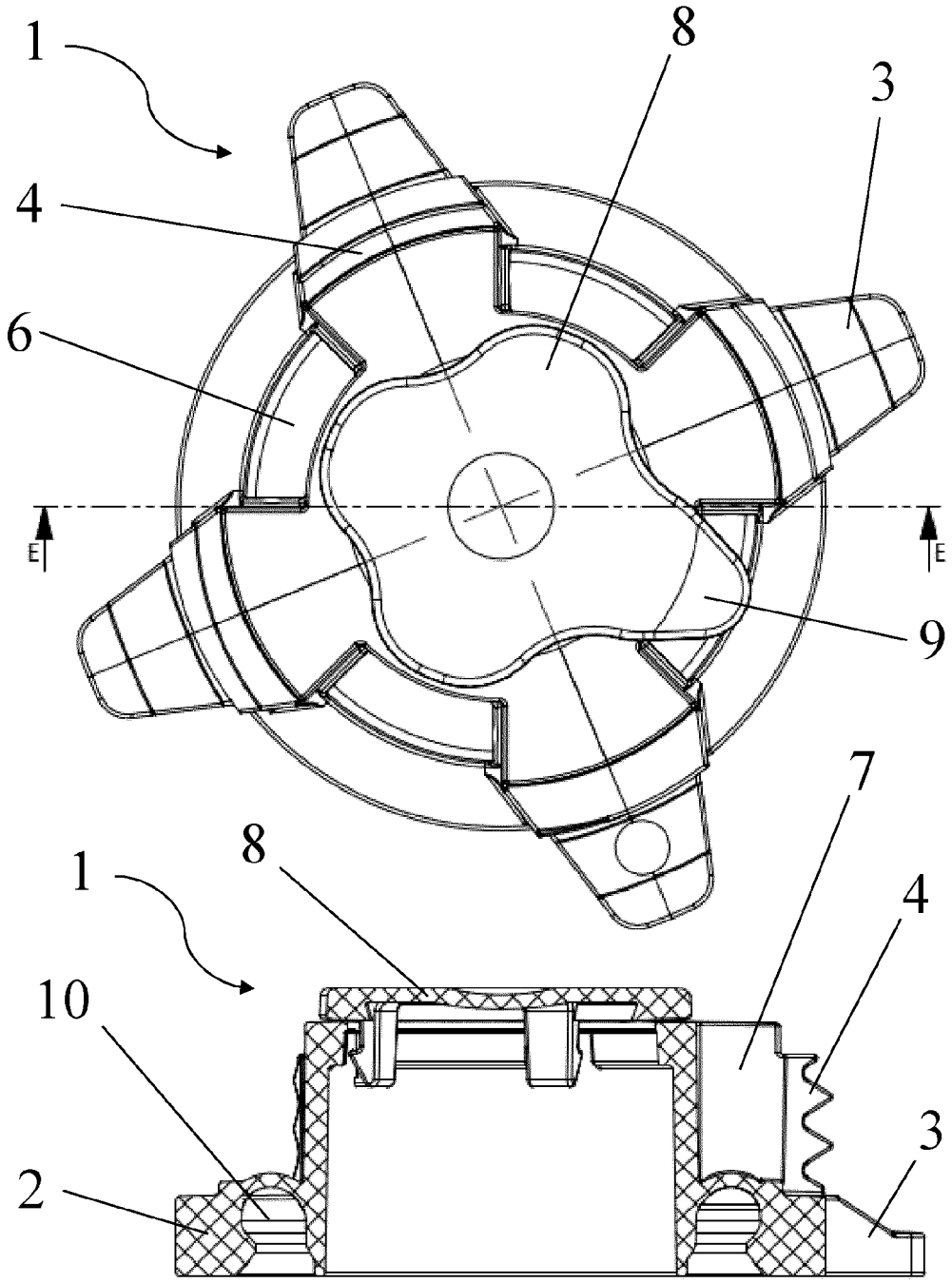

In the following, the invention is discussed more in detail with reference to preferred embodiments shown in the drawings in which FIG. 1 shows a bottom view of an embodiment of an interface ring according to the present invention, FIG. 2 shows a side view of an interface ring according to the present invention, FIG. 3 shows a cut representation of an interface ring according to the present invention, FIG. 4 shows a top view of an embodiment of an interface ring according to the present invention, FIG. 5 shows a perspective view of an interface ring according to the present invention, FIG. 6 shows a cut representation of the same interface ring mounted on a valve cup of a container, FIG. 7 shows a perspective view of the interface ring mounted on a valve cup of a container, FIG. 8 shows a cut representation of the interface ring according to the present invention, FIG. 9 shows a cut representation of the interface ring mounted on a valve cup of a container according to the present invention.

The FIGS. 1 to 9 show an interface ring 1 for mounting a container 12 to an applicator.

This interface ring 1 comprises of a circular socket 2 with a plurality of laterally extending protrusions 3. The socket 2 is used for mounting the interface ring 1 on a valve cup 10 of a container 12. The interface ring 1 further comprises of a cylindrical thread 4, which is arranged above the socket 2. The cylindrical thread 4 can be screwed into a corresponding thread of an applicator. The cylindrical thread 4 presents a plurality of interruptions 6 extending axially from the socket 2 to the upper end of the thread 4. These interruptions 6 divide the threat into thread portions. As the thread 4 is interrupted it can be more easily be forced into an inaccurate basket or into a basket that has a thread with a slightly different pitch.

A security and tamper evidence seal 8 is located above a central cylindrical opening 5 extending through the interface ring 1 in the centre of the thread 4 and the socket 2. This security and tamper evidence seal 8 protects the valve stem 11 from forced and therefore from unwanted actuation of the valve of a container 12, when the interface ring 1 is mounted on the container 12 as can be seen in FIG. 6. In order to pull off the security and tamper evidence seal 8 before the container 12 is mounted into a basket of an applicator, the security and tamper evidence seal 8 is equipped with a removing aid 9.

The interface ring has vertical ribs 7 laterally extending mostly parallel to the radial axis of the interface ring 1.

When the interface ring is mounted on a container 12, these vertical ribs 7 are deformed as can be seen in FIGS. 6, 7 and 9. This deformation of the vertical ribs 7 results in a higher resistance of the interface ring against turning and buckling, while the interface ring 1 is mounted on the container 12. The valve cup 10 deforms the vertical ribs 7, when the interface ring 1 is mounted on the container 12. By varying the mounting force, the vertical ribs 7 are deformed more and are fixed in a less stiff manner around the valve cup 10 which results into a lower buckling load.

The invention claimed is:

1. An interface ring (1) to be placed in the interface between a container and an applicator comprising a circular socket (2) with a plurality of laterally extending protrusions (3), a cylindrical thread (4) being arranged above the socket (2), a central cylindrical opening (5) extending through the interface ring (1) in the centre of the thread (4) and the socket (2), wherein the thread (4) presents a plurality of interruptions (6) extending axially from the socket (2) to the upper end of the thread (4), the interruptions (6) dividing the thread (4) into thread portions, wherein the interface ring (1) comprises deformable vertical ribs (7) laterally extending essentially parallel to the radial axis of the interface ring (1) wherein the deformable ribs (7) deform when the interface ring (1) is mounted on an outer rim of a cup a valve or by other means on to the container.

2. The interface ring (1) according to claim 1, wherein a security and tamper evidence seal (8) is provided with extends at least partially over the opening (5) of the interface ring (1).

3. The interface ring (1) according to claim 2, wherein the security and tamper evidence seal (8) is provided with a removing aid (9) allowing to be seized in order to pull-off the security and tamper evidence seal.

4. Use of an interface ring (1) according to claim 1 between a valve of an aerosol dispenser and an aerosol container.

* * * * *